United States Patent [19]

Calvert

[11] 3,945,634

[45] Mar. 23, 1976

[54] METHOD AND MEANS FOR STACKING VENEER SHEETS

[76] Inventor: Harry B. Calvert, R.R. No. 2, Hespeler, Ontario, Canada

[22] Filed: June 18, 1974

[21] Appl. No.: 480,571

[52] U.S. Cl. ..... 271/183; 271/209

[51] Int. Cl.[2] ..... B65H 29/68

[58] Field of Search ..... 271/182, 183, 174, 188, 271/207, 209, 177; 214/6 D, 6 H

[56] References Cited

UNITED STATES PATENTS

| | | | |
|---|---|---|---|
| 1,560,113 | 11/1925 | Sandaljian | 214/6 D |
| 2,566,240 | 8/1951 | Mursch | 271/182 X |
| 2,813,637 | 11/1957 | Perry | 214/6 H |
| 3,081,082 | 3/1963 | Spooner | 271/183 |
| 3,087,725 | 4/1963 | Duncan | 271/174 |
| 3,232,605 | 1/1966 | Plummer | 271/183 |

*Primary Examiner*—Richard A. Schacher
*Attorney, Agent, or Firm*—Wolfe, Hubbard, Leydig, Voit & Osann, Ltd.

[57] ABSTRACT

A veneer stacker for receiving sheets of veneer at a relatively high rate of speed and assembling them into a uniform stack. The stacker utilizes the velocity of the veneer sheet, acting against a series of curved guide shoes, for supporting the sheet by means of centrifugal force, while guiding it to a stacking position. As the sheet approaches the stacking position, it initiates a momentary vacuum braking action adapted to draw the sheet into intimate engagement with the guide shoes, stopping the sheet, thereby removing its supporting force. Continuously rotating vacuum drums engage the lead edge of the falling sheet for positioning it against an aligning forward stop, and correcting skew of the sheet as an incident to such positioning.

23 Claims, 16 Drawing Figures

48
49
41
42
44
45
47
31
95
33
102
60
110
29
64
96
65
111
34
59
20
35
51
61
27
46
50
30
54
55
56
21
41
41
41
22

METHOD AND MEANS FOR STACKING VENEER SHEETS

This invention relates to stacking devices, and more particularly to those for handling and stacking sheets of veneer.

In the veneer/plywood industry, to produce relatively continuous strips of veneer of uniform thickness, logs are axially chucked between driving spindles and turned against a mechanically advanced knife. The strips of veneer which are thus "peeled" from the logs are directed along multiple conveyors to a clipping station for forming individual sheets. The strips are normally 102 inches long (transverse to the direction of travel), the clipper being designed to selectively cut away defective wood and, where possible, convert all material into full width sheets approximately 54 × 102 inches. The veneer sheets which emerge from the clipper are directed along a grading conveyor for stacking according to size and grade. Accordingly, the veneer line includes means for segregating sheets according to their width and grade, and routing sheets of substantially like characteristics to associated stacking stations. The stacking stations are adapted to receive the moving sheets and assemble them into a relatively uniform stack.

Heretofore, a major limitation on the productivity of veneer producing lines has been the maximum operating speed of the available veneer stackers, in most cases being limited to a practical maximum of 300 feet per minute. Certain of these prior art veneer stackers involve the use of mechanical supports to convey the incoming sheet across the pile, associated with means for releasing the sheet for a free drop to the pile. Others utilize vacuum conveyors for transporting the sheet over the pile, operating in conjunction with articulated bars to force the sheet from the conveyor.

Many prior art veneer stackers also include reciprocating mechanical aligning means for engaging the lead edge of the sheet and positioning it against a forward stop. Not only are the reciprocating sheet aligners speed limiting, but in most cases they are incapable of effectively realigning misaligned sheets to form a neat pile. It should be noted that the development of automatic equipment for unstacking and feeding the veneer sheets into the subsequent drying oven has emphasized the importance of providing a veneer stack having a uniform lead edge.

It is easily appreciated that prior art veneer stackers are not only quite complex, but are somewhat limited in their ability to positively control the sheet during the braking operation. Additionally, considering the size of the stacker (dictated by the sheet size) and the fact that many of such stackers utilize reciprocating sheet strippers, edge aligners, etc., the speed limiting dynamic problems become evident.

With the foregoing in mind, it is an aim of the present invention to provide a veneer stacker having a different operational mode than those known heretofore, in which the sheet is positively guided into stacking position by stationary guide means adapted to support the sheet by means of the sheet velocity.

It is a general aim of the present invention to increase the efficiency of a veneer producing line by stacking the produced sheets at a substantially higher rate of speed than accomplished heretofore. In this regard, it is an object to provide a high speed veneer stacker utilizing simplified mechanisms to minimize dynamic problems.

A further objective of the invention is to provide a veneer stacker capable of reliable operation at high speeds and able to produce a neatly aligned veneer package.

It is a more detailed object of the invention to provide a veneer stacker, utilizing curved guides for guiding the sheet into stacking position while supporting this sheet by means of centrifugal force. In conjunction with the foregoing object, it is an additional object to provide vacuum valving synchronized with sheet position for braking the sheet thereby to remove its supporting force.

It is a further detailed object to provide continuously moving nonreciprocal final positioning means for aligning the lead edge of the sheet with the stack. In this regard it is an object to provide an edge aligning means able to effect a clutching action with the veneer sheet thereby to correct sheet misalignment.

Other objects and advantages will become apparent from the following detailed description when taken in conjunction with the drawings, in which.

While the invention will be described in conjunction with a preferred embodiment, it will be understood that there is no intent to limit it to that embodiment. On the contrary, the intent is to cover all alternatives, modifications and equivalents as may be included within the spirit and scope of the invention as defined by the appended claims.

Figure 1:
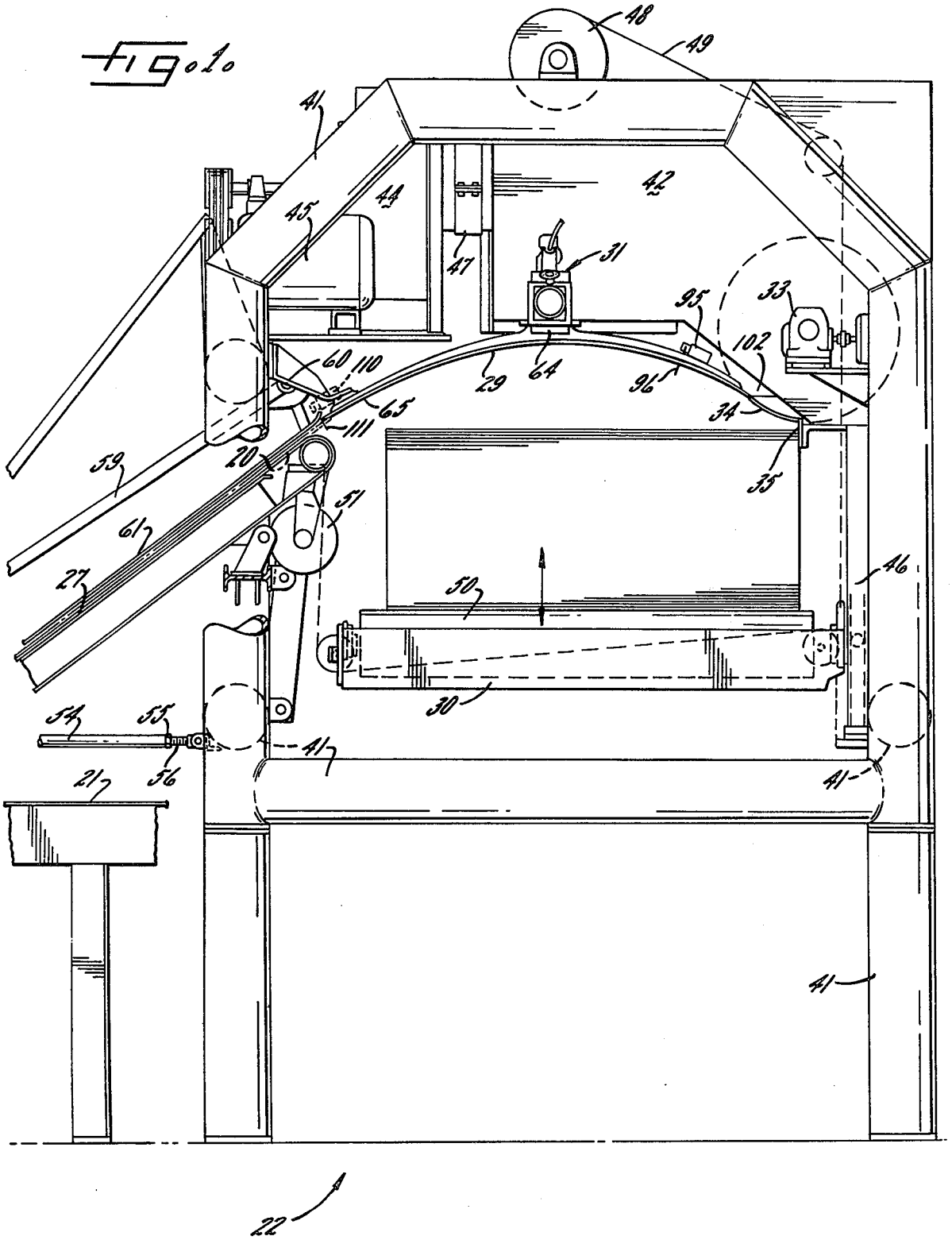
FIG. 1 is a side elevational view showing an illustrative veneer stacker constructed in accordance with the invention.
Figure 2:
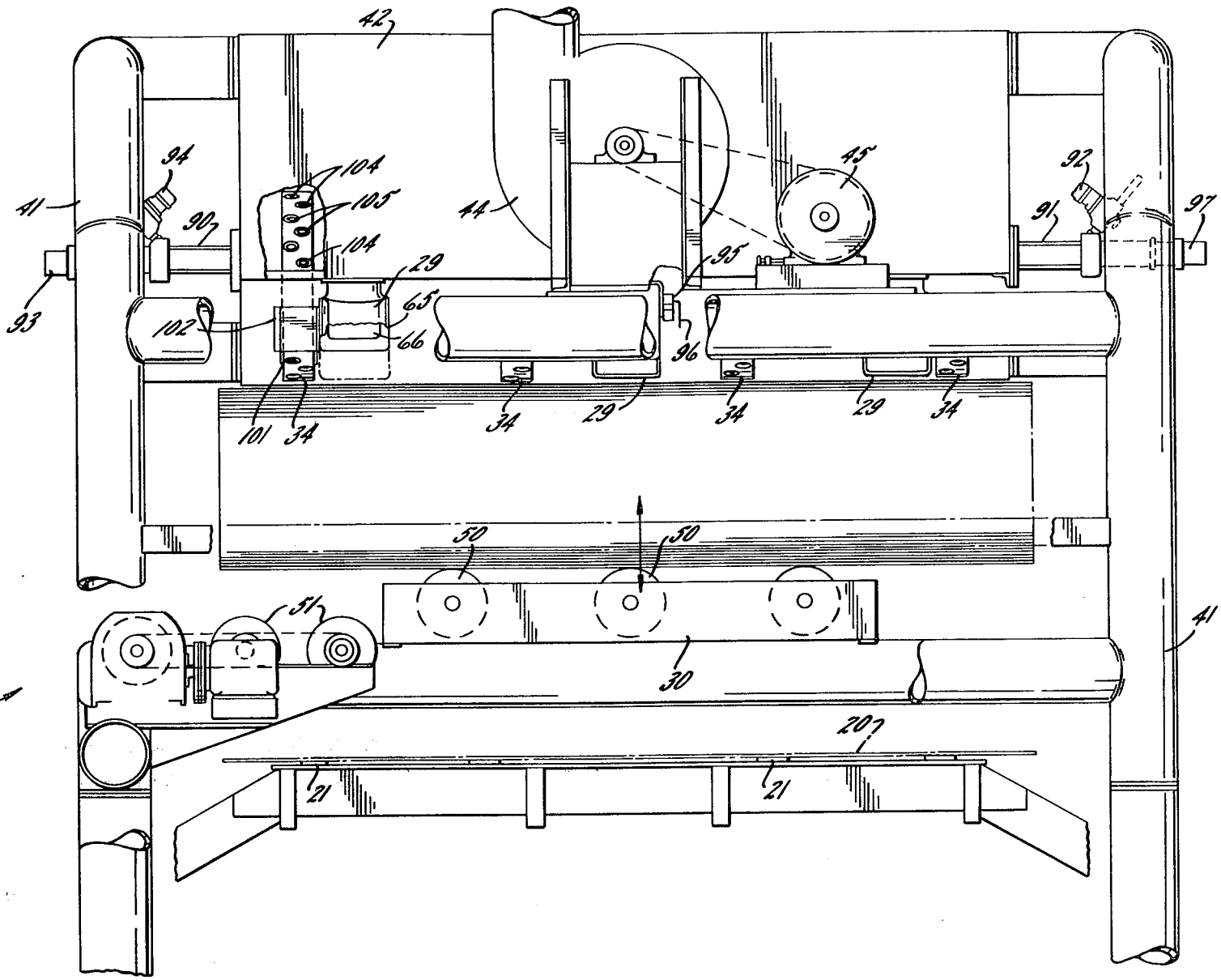
FIG. 2 is an end elevational view of the stacker of FIG. 1 with the infeed conveyor removed for clarity.
Figures 3, 4, 5:
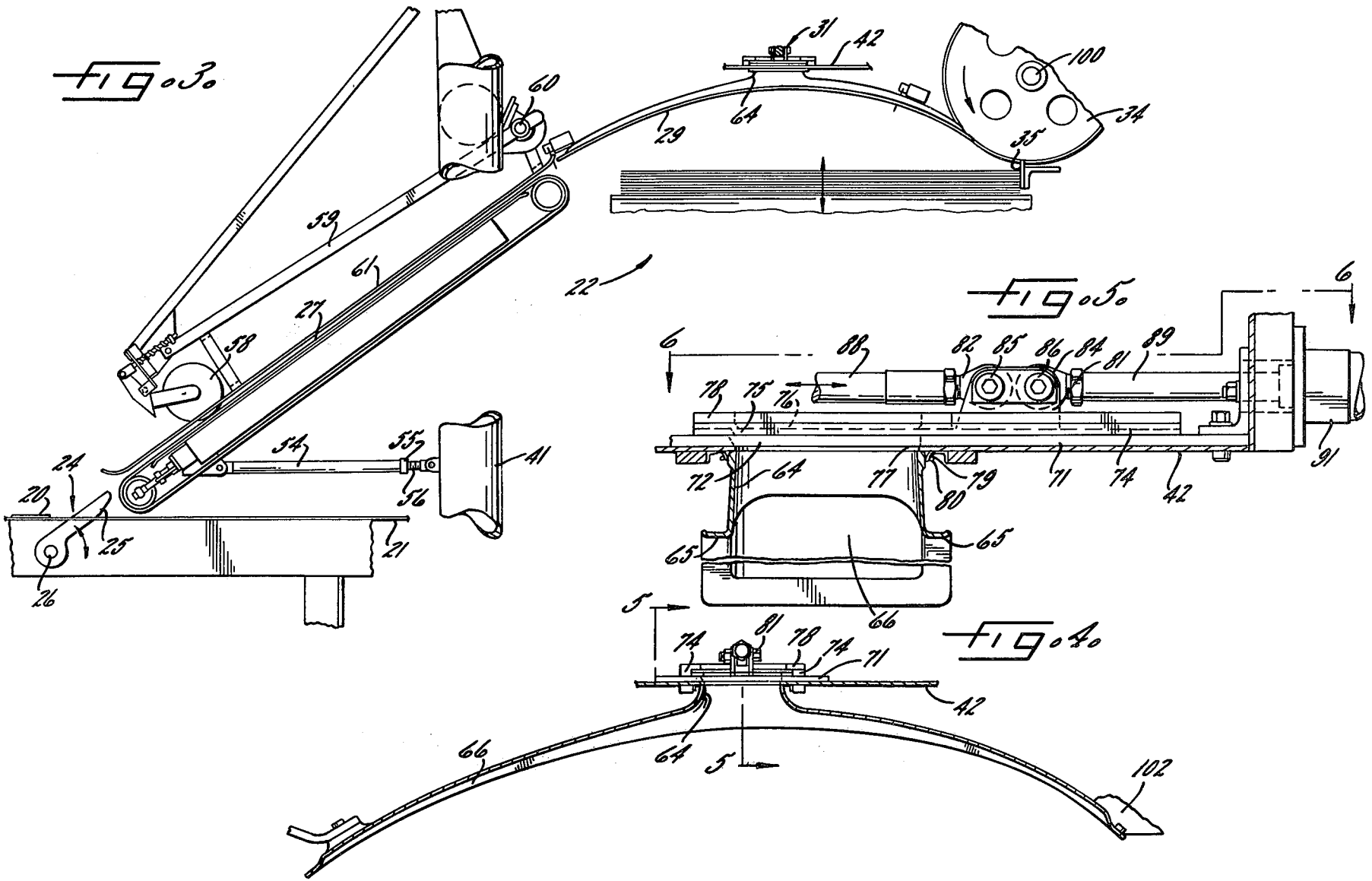
FIG. 3 is a partial side elevational view showing the infeed conveyor arrangement.
FIG. 4 is a sectional view of a guide shoe with its associated vacuum valve.
FIG. 5 is a sectional view taken along the lines 5—5 of FIG. 4 showing the vacuum valve.

Turning now to the drawings, and particularly to FIGS. 1, 2 and 3, there is shown an illustrative veneer stacker exemplifying the present invention. A grading conveyor 21 is provided for carrying sheets of veneer 20 from the veneer clipper (not shown) to the stacking stations, one of which is illustrated at 22. It will be apparent that a plurality of such stacking stations may be provided, each adapted to accept sheets of a certain nominal width. The illustrated stacking station 22 is capable of accepting full size sheets of approximately 54 inch width (in the direction of travel) and 102 inch length.

For diverting selected sheets for stacking, a sheet diverter 24, including a series of diverter bars 25, is pivoted on a shaft 26 mounted below the surface of the conveyor 21. The diverter may be operated in response to automatic scanning equipment to pivot the deflecting surface thereof above the surface of conveyor 21 by a linkage (not shown) for stacking selected sheets of a predetermined size. An upwardly directed infeed conveyor 27 is provided for accepting the deflected sheets from the main conveyor 21, and is arranged to be driven at a relatively constant speed.

In accordance with an important aspect of the invention, inwardly curved guide means are provided at the output end of the infeed conveyor 27, shown herein as guide shoes 29. The upstream ends of the guide shoes 29 are arranged to be roughly tangential to the infeed conveyor, and to cause the sheet to follow a curved path into position over a stacking table 30. The guides are sufficiently curved, as will be explained in more detail below, so that velocity of the incoming sheet produces a sufficient centrifugal force to make the sheet self-supporting. Accordingly, the sheet is guided into stacking position on the underside of the guide tracks without the need for underlying supports or overhead vacuum conveyors.

As the sheet approaches the stacking position, it activates braking means including a vacuum valve 31 to cause the momentary application of vacuum to the internal cavity formed within the guide shoes 29. The guide shoes thus act as braking nozzles, causing the vacuum to intimately draw the veneer sheet to the guide shoes, thereby stopping it. The sheet, having lost its velocity, also loses its means of support, and falls to the stack forming on the stacking table 30.

Means are provided for engaging the lead edge of the stopped sheet and aligning that edge with the forming stack as the sheet falls to the pile. In the illustrated embodiment, a series of vacuum drums 34 are positioned to coincide with the downstream end of the curved guides 29 such that the lead edge of the stopped sheet contacts the smoothing drums. The hollow drums 34, being contained within a vacuum plenum 42, and having a patterned array of peripheral ports, attract the lead edge of the sheet. A vacuum drum drive 33 rotates the drums 34 at a relatively slow constant speed for carrying the lead edge of the falling sheet to an aligning stop 35 adapted to strip the sheet from the drums.

In summary, it is apparent from the foregoing that stationary guides are provided to guide the sheet into stacking position while the sheet is being supported by means of centrifugal force, braking means responsive to sheet position are provided to stop the sheet and thereby eliminate its source of support, and nonreciprocating aligning means are used to positively and accurately guide the lead edge of the sheet as it falls to the pile.

Referring in greater detail to FIGS. 1, 2 and 3, it is seen that the veneer stacker generally indicated at 22 is supported over the main veneer conveyor 21 by means of a frame structure 41. Accordingly, the conveyor 21 may continue past stacking station 22, the entire stacking operation being performed above the main conveyor level. The frame 41 supports a vacuum plenum 42 which functions as a vacuum source for both the braking nozzles 29 and the vacuum drums 34. The vacuum is produced by an exhaust fan 44 coupled to the plenum by a suitable coupling 47 and driven by a fan motor 45.

An elevating table 30, including means for controlling the vertical position thereof, is provided for receiving the veneer sheets. The table is constrained within guides 46, and is vertically positioned by elevating drive 48 coupled to the table by a chain 49. In a preferred embodiment, the elevating drive 48 is arranged to maintain the surface of the elevating table 30, or the top surface of the pile thereon, a nominal distance, such as three-fourths inches, below the smoothing drums 34. Accordingly, the table descends as the height of the veneer stack increases, ultimately reaching it lowermost position at which point the veneer package is unloaded. As seen in FIG. 2, the table includes three transverse rollers 50 for allowing the veneer package to be efficiently removed from the stacking device. A series of powered outfeed rollers 51 may be provided at the output end of the stacker, for withdrawing the veneer package (to the left as illustrated in FIG. 2) when the elevating table reaches its lowermost position. Subsequently, the elevating table is again raised to form a new stack of veneer sheets.

As noted above, the infeed conveyor 27 is adapted to accept sheets diverted from the main conveyor for stacking. The belt is equipped with a drive 51 adapted to maintain the conveyor speed at approximately 750 to 800 feet per minute, independently of the speed of the grading conveyor 21. Accordingly, the veneer stacker is adaptable to various veneer producing plants, having a speed greater than most presently existing equipment, but allowing the upgrading of associated components to match the speed of the stacker. As the grading conveyor 21, which transports sheets from the clipper to the stacker, is normally operated at a slightly higher speed than the clipper infeed conveyor to introduce gaps between adjacent sheets, it is apparent that the speed of conveyor 21 may be further increased, if desired.

The infeed conveyor 27 is upwardly inclined to be approximately tangential to the input end of the guide shoes 29. A support member 54 is coupled between the lower end of the conveyor 27 and supporting frame 41, having an internally threaded portion 55 cooperating with threaded rod 56 for adjusting the angle of infeed conveyor 27.

The conveyor 27 is preferably formed of a plurality of relatively narrow individual belts having upper surfaces adapted to frictionally engage the veneer sheets. To provide an additional measure of positive control, a pressure roller 58 is provided for forcing the veneer sheets into frictional engagement with the driving conveyor belts. The pressure roller 58 is arranged near the lower portion of the conveyor, and may be mounted on supporting member 59 pivoted at 60 as shown for easy access to the conveyor belts when needed. Also provided are a series of restraining straps 61 for preventing the sheet from raising above the conveyor surface.

In accordance with an important aspect of the invention, a plurality of guide shoes are provided for guiding the sheet into stacking position while supporting the sheet by means of the sheet velocity, and for coupling a braking force to the sheet as the sheet approaches stacking position. In the illustrated embodiment, three guide shoes are spaced across the 102 inch length of the incoming sheet, being suitably fastened to the support structure 41, and coupled to the vacuum plenum 42 by means of a central inlet throat 64. Each guide shoe includes a pair of guide tracks or side flanges 65, arranged to serve as inverted runners or tracks for the incoming veneer sheet, and to define a central cavity or chamber 66. As will become apparent, the cavity 66 receives vacuum via inlet throat 64 to forcibly draw the veneer sheet against the tracks 65 thereby to stop the sheet. The tracks are shaped in the form of a concave curve to divert the sheet to follow a curved path adapted to cause the sheet, by virtue of its velocity, to become self-supporting, while being guided into stacking position. More specifically, the incoming sheet, by virtue of the velocity imparted by the infeed conveyor 27, exerts a force against the guide tracks 65. The reaction to that force, commonly referred to as centrifugal force, is a supporting influence on the sheet. Since the rate curvature is so related to the sheet velocity that the centrifugal force will overcome the force of gravity, the sheet will become self-supporting. In the illustrated embodiment, the radius of curvature of the upstream section of the guide tracks 65 is approximately 55 inches, which, in conjunction with a sheet velocity of approximately 720 feet per minute, generates a centrifugal force of slightly over 1 g. Thus, the incoming veneer sheet is made to be self-supporting over the entire range of infeed conveyor speeds.

As best shown in FIG. 4, the guide track is in the nature of a compound curve, having a decreased radius of curvature at its downstream end. In a preferred embodiment, the radius of the downstream section is approximately half the radius of the upstream end, being adapted to maximize the centrifugal force on the leading portion of the sheet. Accordingly, the leading edge is guided even more positively as the sheet approaches stacking position, resulting in a smooth transfer of the sheet from the guide tracks to the vacuum drums to be described below.

In a preferred embodiment, the guide shoes are formed of molded fiberglas, thereby providing an easily fabricated unit. Additionally, the fiberglas guide tracks, in conjunction with the vacuum braking arrangement, have proven very effective in consistently stopping the sheet in its intended stacking position. Finally, it has been found that the fiberglas tracks exhibit unexpected durability in the illustrated embodiment, possibly resulting from an interaction between the fiberglas track and the wooden sheet.

For stopping the sheet and consequently removing its means of support, braking means, including a valved vacuum source operating through the braking nozzles, is provided. To that end, each braking nozzle 29 includes a central aperture or throat 64 communicating with the internal chamber 66 formed between the guide tracks 65. The throat portion 64 of each braking nozzle 29 is coupled to the vacuum plenum 42, with a valve assembly, generally indicated at 31, interposed for controlling the application of vacuum to the guide shoes. As will become apparent, the vacuum valve must not only be reasonably fast acting, but must also supply sufficient vacuum to brake the sheet within a known distance. Accordingly, the guide shoe throat 64 is made reasonably large, in the illustrated embodiment being approximately 6 inches in diameter.

Referring particularly to FIG. 4, it is seen that the guide shoes are well adapted to perform the required rapid braking. Initially, the volume of the chamber formed between the guide tracks is minimized by minimizing the guide shoe profile so that the chamber may be quickly evacuated for applying braking force. The small volume is also beneficial in allowing the sheet to be quickly released from the guide shoes when the vacuum valve is closed. Finally, it is seen that the braking nozzle chambers include a relatively constant taper from the inlet throat to the ends thereof for providing an unobstructed flow path to achieve a high rate of vacuum propagation.

Figure 6:
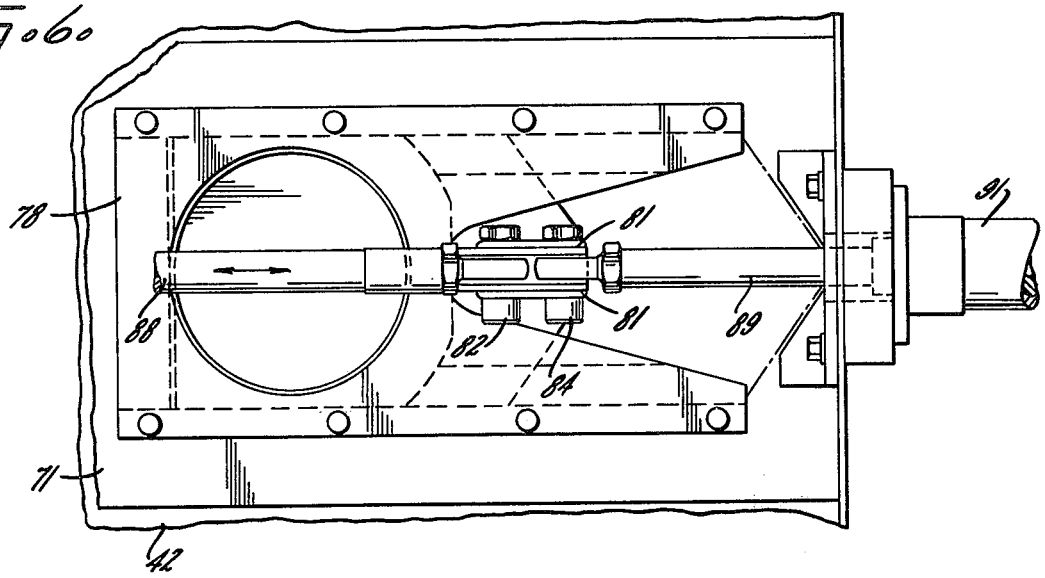
FIG. 6 is a plan view of the vacuum valve taken along the lines 6—6 of FIG. 5; and FIGS. *7a–7e* and *8a–8e* are schematic illustrations showing the veneer sheet in various positions in the stacker.

Turning now to FIGS. 4–6, there is shown the vacuum valve 31 adapted to apply braking vacuum to the guide shoes. The valve is formed on a base member 71 affixed to the inside of the vacuum plenum 42, the base having three apertures 72, one corresponding to each guide shoe. Affixed to the base member 71 at each valve position are a pair of guide members 74 for restraining the slidable valve element 75. Also provided is an overlying shear ring 76, also having a central aperture, as well as an apertured cover plate 78 overlying the valve member, the shear ring, and the guide members. It is seen that the valve member 75 includes a sharpened leading edge, cooperating with a similarly sharpened edge on the shear ring 76. Such an arrangement allows the valve to efficiently sever any wood fragments drawn into the area, which might otherwise become lodged in the valve throat. The guide shoe throat 64 is positioned adjacent the plenum aperture 77, and sealing means including a resilient seal member 79 and retaining ring 80 are provided for assuring a positive seal. With the valve member 75 in the position illustrated in FIG. 5, it is seen that no vacuum is supplied to guide shoes. However, when the valve is moved to the right of the illustrated position, the vacuum within plenum 42 is allowed to communicate with the guide shoes 29 thereby to provide braking force to the nozzle assemblies.

For positioning the valve member 75, the slidable member includes a pair of upstanding members 82, forming a clevis into which rod ends 82 and 84 are secured via bolts 85 and 85, respectively. Connecting rods, such as rods 88 and 89, are provided for joining the three valve members 75 together, as well as for securing the valves associated with the two outermost guide shoes to the brake valve actuator. As best seen in FIG. 2, the brake valve actuator comprises a pair of single acting air cylinders 90 and 91 arranged at opposite ends of the vacuum plenum 42 for moving the valve members 75 in unison between their leftmost closed position and their rightmost open position. More specifically, when it is desired to apply braking force through the guide shoes, a signal is supplied to solenoid valve 94 for actuating air cylinder 90, thereby opening the vacuum valves. Similarly, solenoid 92 is energized to provide high pressure air to cylinder 91 for rapidly closing the vacuum valves thereby to remove the braking force. To further improve the response time of the vacuum valve, means may be provided for applying a two level operating signal to the solenoid valves 92 and 94, including a brief initial overvoltage portion for initiating valve movement. Additionally, it is sometimes desirable to actuate the closing solenoid 92 before deactivating the opening solenoid 94. This overlap in operating signals provides a rapid closing time. Hydraulic dampers 93 and 97 are coupled to the air cylinders 90 and 91, respectively, for absorbing the shocks produced as a result of the rapid vacuum valve actuation.

For synchronizing the operation of the vacuum valves with sheet position, a brake switch 95 is provided having an actuator 96 depending into the path of sheet travel. When the incoming sheet deflects the actuator 96, the switch is closed producing a signal which energizes solenoid 94 for opening the vacuum valves. The signal produced by the switch 95 also actuates a delay timer which, after a predetermined delay period, de-energizes solenoid 94 and energizes solenoid 92 for closing the vacuum valves. The position of the brake switch 95 is set such that the sheet will be stopped with its lead edge in engagement with the vacuum drums 34. Additionally, the period of the delay timer is set such that the vacuum will be released immediately after the forward motion of the sheet is substantially stopped. Accordngly, as the sheet approaches the stacking position, braking force is momentarily applied to stop the sheet and immediately release it for a fall to the stacking table.

According to an important aspect of the invention, a nonreciprocating (in other words, arranged for motive in a continous path) final sheet positioning means is provided for accurately aligning the individual sheets with the forming stack. To that end, a series of four vacuum drums 34 are positioned with the vacuum plenum 42 on a common drive shaft 100, and are rotated by a drive 33 to maintain a continuous surface speed of approximately 30 to 50 feet per minute. The vacuum drums have a relatively large diameter to assure effective engagement with the veneer sheet. As best shown in FIG. 2, the vacuum plenum 42 is provided with apertures 101 and a shroud member 102 for allowing an arcuate portion of the rotating vacuum drum to project from the plenum. It is apparent that this arrangement allows the exposed portion of the vacuum drum to engage the leading edge of the veneer sheet when it is in its stopped position. The vacuum drums 34 are hollow, shell like members having a patterned array of peripheral ports 104 to allow the vacuum within the plenum to draw the lead edge of the sheet to the vacuum drum. In a preferred embodiment, the periphery of each vacuum drum is covered with a layer of rubber or the like, the rubber covering being counterbored to form recesses 105 surrounding the ports, to increase the working area thereof.

It is apparent from the foregoing description that the vacuum drums provide sufficient attraction to engage the leading edge of the sheet when the sheet is in the stopped position, and to carry the leading edge to the forward stop 35 while the bulk of the sheet is falling to the pile. Before the sheet is released by the vacuum brake, however, the vacuum drums effect a clutching action on the veneer sheet, attracting the sheet, but failing to overcome the restraining force, thereby to slide over the sheet. Accordingly, the drums carry the leading edge of the sheet forward to the aligning stop 35 as soon as the restraining force is released.

In carrying out an important object of the invention, the aforementioned clutching action serves to realign veneer sheets presented to the stacker in a slightly misaligned condition. Initially, it is seen in FIG. 1 that the brake valve switch 95 is positioned near the center of the incoming veneer sheets. Accordingly, the switch position is adapted to stop the sheet with the center thereof in stacking position. If the sheet is properly aligned, the entire sheet will be in stacking position. However, even if one edge of the sheet is leading the other, the centrally located brake switch assures that sheet is substantially in stacking position. Accordingly, the vacuum drums will be effective to engage the leading edge and carry it toward the aligning stop. The aforementioned clutching action is effective to draw the entire leading edge of the sheet to the forward stop before the aligning stop completely wipes the sheet from the vacuum drums.

Figure 8A:
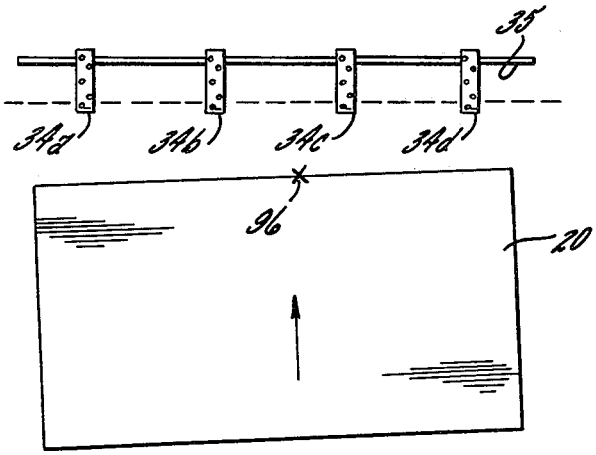
Figure 8B:
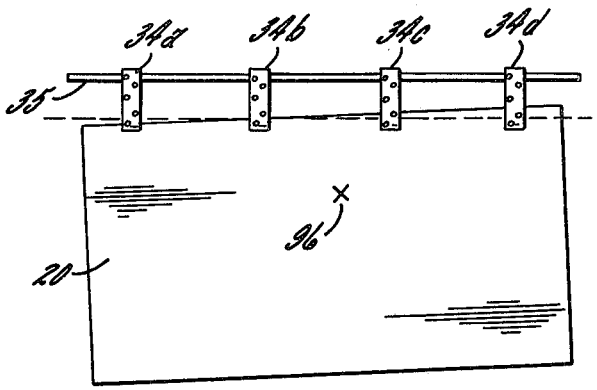
Figure 8C:
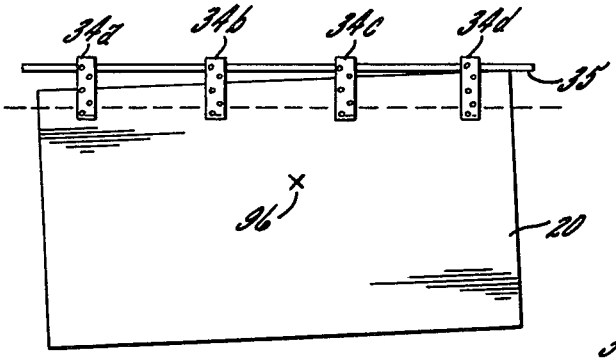
Figure 8D:
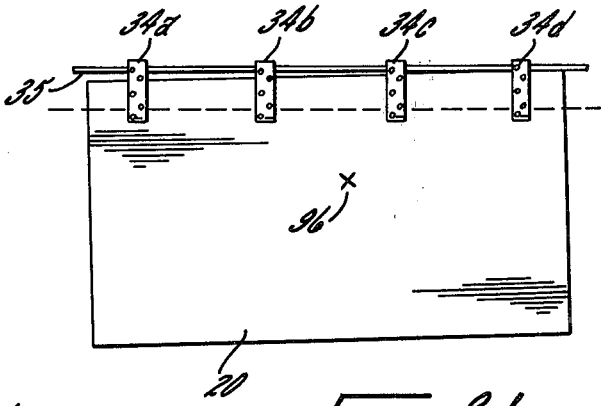
Figure 8E:
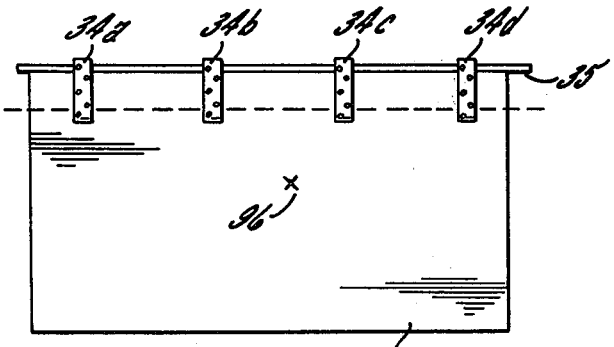

The realigning capability is illustrated in FIGS. 8*a*–8*e*, which show a schematic plan view of the veneer stacker, greatly simplified. The vacuum drums 34*a*–34*d* represent only the peripheral portions thereof projecting from the plenum 42. The dashed line intersecting the vacuum drums represents the preferred position for the stopped sheet before releasing the vacuum brake, being parallel to the aligning stop 35. FIG. 8*a* illustrates the sheet 20 actuating the brake switch, the position of the actuator 96 being indicated by the X. It is seen that the sheet 20 is misaligned, with the right corner being displaced ahead of the left corner. As the actuator 96 is operated by the approximate midpoint of the sheet leading edge, the sheet will be stopped, as illustrated in FIG. 8*b*, in its misaligned condition, but with the sheet center approximately in the preferred position. Accordingly, when the vacuum brake is released, the vacuum drums will carry the sheet forward in its misaligned condition to the position illustrated in FIG. 8*c*. After the right corner of the sheet contacts the aligning stop 35, drum 34*d*, and to a lesser extent drums 34*c* and 34*b*, effect a clutching action by sliding on the sheet. Accordingly, the drums continue to move the sheet forward as illustrated in FIG. 8*d*, correcting the misalignment. When the sheet reaches the aligned position illustrated in FIG. 8*e*, the combination of the weight of the sheet, and the stripping action of the aligning stop cause the sheet to drop to the stack in an aligned condition. The realigning capability thus provided causes the production of a veneer package having a neatly aligned leading edge.

As shown in FIG. 1, a gap safety switch 110 having an actuator 111 depending into the path of sheet travel is mounted at the upstream end of the guide shoes. It is seen that the incoming sheet will activate the gap signal switch 110 as the sheet enters the stacker, and will release the switch 110 as the sheet approaches stacking position. The signal from switch 110 is combined with the signal from the delay timer (for energizing closing solenoid 92) in an AND gate arranged to stop the infeed conveyor in the event both signals are simultaneously present. Accordingly the switch 110, in conjunction with the aforementioned AND gate, is adapted to detect over-width sheets or random pieces of debris that may clog the input to the stacker, and stop the infeed conveyor to prevent damage to the stacker, or to the veneer sheets.

Figure 7A:
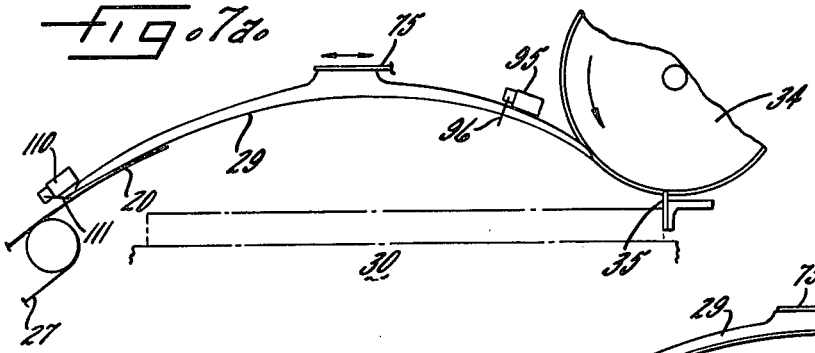
Figure 7B:
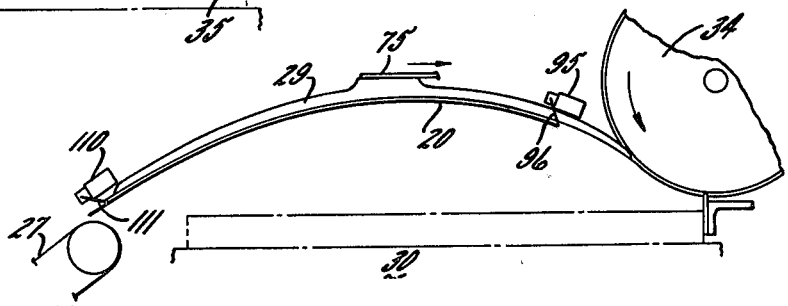
Figure 7C:
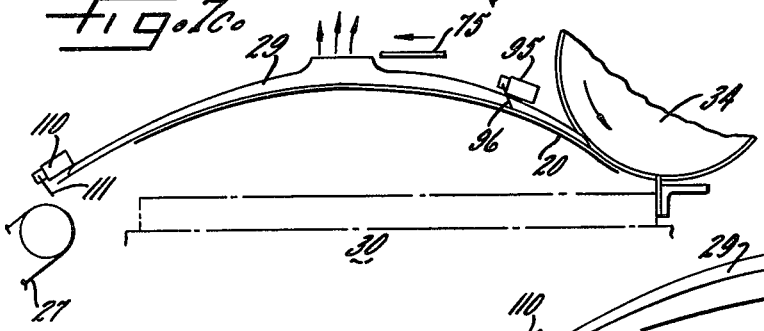
Figure 7D:
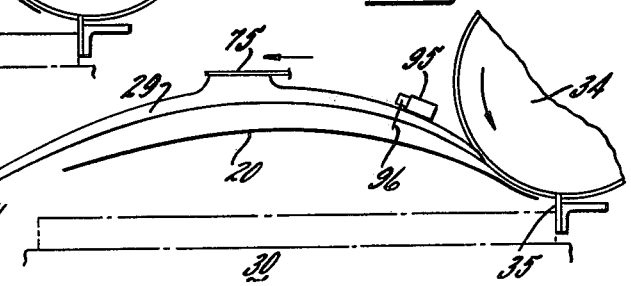
Figure 7E:
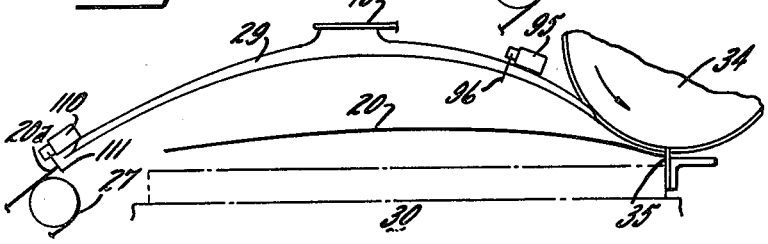

Turning finally to FIGS. 7*a* to 7*e*, the operation of the veneer stacker will be briefly summarized. FIG. 7*a* illustrates a veneer sheet 20 entering the stacking apparatus at the speed of the infeed conveyor, the sheet being tangentially intercepted by the guide tracks 29. FIG. 7*b* illustrates the sheet as it engages the brake switch actuator 96. The sheet is still moving at the speed of the infeed conveyor, having been guided into position by the guide tracks. It is seen that the sheet substantially follows the underside of the guide tracks, being supported by virtue of the velocity imparted by the infeed conveyor. It is at the position illustrated in FIG. 7*b* that the vacuum valves 31 are activated to rapidly provide vacuum to the braking nozzles. Accordingly, the sheet continues to be carried forward, while being intimately drawn toward the braking nozzles, ultimately causing the sheet to stop in the position illustrated in FIG. 7*c*. As the sheet approaches the FIG. 7*c* position, the brake valve delay timer causes the vacuum valve to begin closing, while the vacuum drums 34 attract but slide on the stopped sheet. It should be noted that in FIG. 7*c* the gap safety switch 110 is released, thereby signaling a "safe" condition. In FIG. 7*d*, the vacuum valve is closed, releasing the sheet to fall to the pile while the vacuum drums carrying the leading edge toward the forward aligning stop 35. Finally, FIG. 7*e* illustrates the sheet settling to the pile, while the aligning stop is stripping the leading edge from the vacuum drums. As further illustrated in FIG. 7*e*, the stacker is prepared to receive a new veneer sheet 20*a*.

In view of the foregoing, it will be apparent that what has been provided is a veneer stacker capable of efficient operation at high speed. While the invention has been described in connection with a preferred embodiment, it is apparent that the teachings of the invention extend beyond the scope of that single embodiment. For example, various alternative geometries of infeed conveyor and guide shoe relationships will be apparent. Additionally, the preferred embodiment has been described in connection with an infeed speed of 750 to 800 feet per minute. However, it will be apparent to one skilled in the art to adapt the veneer stacker for operation at other infeed speeds.

I claim as my invention:

1. In a veneer stacker for accepting moving veneer sheets and assembling said sheets on a stack, the combination comprising stationary guide means for guiding a moving veneer sheet into position over the stack, said guide means including an inverted concave surface to divert the sheet to follow a curved path adapted to support said sheet, means for stopping the sheet while said sheet is in contact with the guide means thereby to remove its source of support, and means for aligning the sheet with the stack as the sheet falls to the stack.

2. A stacker for veneer sheets comprising, in combination, means for imparting a predetermined velocity to the veneer sheet, guide means utilizing the velocity of the sheet to support said sheet while guiding the sheet into position over a stack, braking means for stopping the sheet while said sheet is in contact with the guide means thereby to allow the sheet to fall to the stack, and means for aligning the sheet while the stack as the sheet falls to the stack.

3. The veneer stacker as set forth in claim 2 wherein the guide means comprises a plurality of like concave overhead guide tracks, the rate of curvature of said guide tracks being adapted to sufficiently oppose the velocity of the sheet to cause the sheet to follow the underside of the guide tracks.

4. The veneer stacker as set forth in claim 3 wherein the concave guide tracks comprise a compound curve including an upstream portion and a downstream portion, the upstream portion having a radius of curvature adapted to produce a centrifugal force sufficient to support the veneer sheet moving at the predetermined velocity, the downstream portion having a radius of curvature which is less than the radius of curvature of the upstream portion thereby to increase the centrifugal force on the leading edge.

5. The veneer stacker as set forth in claim 3 wherein the guide tracks are arranged in pairs, each pair defining an internal chamber having an inlet, the braking means comprising a source of vacuum coupled to the inlets, and a valve between the vacuum source and the inlets, the opening of the valve serving to draw the sheet to the guide tracks thereby stopping the sheet.

6. The veneer stacker as set forth in claim 5 wherein the braking means further includes a sensor having an actuator interposed in the path of sheet travel, and means responsive to actuation of the sensor for opening the valve, whereby the braking means is made responsive to sheet position.

7. The veneer stacker as set forth in claim 2 wherein the aligning means comprises a plurality of hollow drums, a vacuum chamber enclosing said drums, the chamber including apertures to expose an arcuate portion of each drum to the stopped sheet, means for rotating said drums, the drums each including a patterned array of ports on the outer periphery thereof thereby to cause the leading edge of the sheet to be attracted to the rotating drums, and an aligning stop for stripping the leading edge of the sheet from said drums thereby to align said leading edge with the stack.

8. A veneer stacker for receiving sheets of veneer and stacking said sheets on a stack comprising in combination an infeed conveyor for inparting a predetermined velocity to the sheet, overhead guide means for receiving the sheet from the conveyor on the underside of the guide means and guiding the sheet to a position generally over the stack, the guide means having a concave curvature adapted to impose an accelerating force on the sheet of at least 1 g. thereby to centrifugally support the sheet, means responsive to the position of the sheet for applying a braking force adapted to stop said sheet, and aligning means arranged for motion in a continuous path engaging the leading edge of the stopped sheet for aligning said leading edge with the stack as the sheet falls to the stack.

9. The veneer stacker as set forth in claim 8 wherein the infeed conveyor is upwardly directed to cause the veneer sheet to enter the guide means in a path which is substantially tangential to the input end of the guide means.

10. The veneer stacker as set forth in claim 8 wherein the guide means comprises a plurality of guide shoes, each of said guide shoes comprising a pair of guide tracks defining a central cavity therebetween, the cavity having an inlet, the braking means comprising a vacuum source coupled to the inlets, valve means interposed between the vacuum source and the inlets, and means for momentarily opening the valve means for applying vacuum to the guide shoes thereby to intimately draw the veneer sheet to the guide shoes.

11. The veneer stacker as set forth in claim 10 wherein each of the guide shoe cavities includes a substantially constant taper from the inlet to the respective guide shoe ends, thereby to decrease the cavity volume while providing a substantially unobstructed flow path.

12. The veneer stacker as set forth in claim 11 wherein each guide shoe in an integral unit molded of fiberglas.

13. The veneer stacker as set forth in claim 10 wherein the valve means comprises a valve throat, a slidable valve element, means for restraining said valve element for reciprocation to open and close said throat, the slidable element including a sharpened lead edge, a stationary shear ring associated with the slidable element and having a cooperating sharpened edge, whereby the valve is adapted to sever obstructions to clear the valve throat.

14. The veneer stacker as set forth in claim 9 wherein the guide means comprises a plurality of guide shoes, each of said guide shoes comprising a pair of guide tracks defining a central cavity therebetween, the cavity having an inlet, the braking means comprising a vacuum source coupled to the inlets, valve means interposed between the vacuum source and the inlets, a brake switch having an actuator interposed in the path of sheet travel, means responsive to the actuating of the brake switch for opening said valve means, the switch and actuator being positioned so that the veneer sheet is stopped substantially over the stack, and means for closing said valve means for releasing the sheet to fall to the stack.

15. The veneer stacker as set forth in claim 8 wherein the aligning means includes means for effecting a clutching action on the leading edge of the veneer sheet thereby to realign misaligned sheets.

16. The veneer stacker as set forth in claim 8 further including an elevating stacking table beneath the guide means for receiving the veneer sheets, and means for controlling the height of the stacking table in accordance with the height of the stack of veneer sheets thereon.

17. The veneer stacker as set forth in claim 8 wherein the aligning means comprises a plurality of laterally spaced drums, an enclosure for the drums, means for creating a vacuum in the enclosure, the drums being positioned near the leading edge of the stopped veneer sheet, apertures in the enclosure for exposing an arcuate peripheral portion of the drums to said leading edge, the drums including a patterned array of ports on the outer periphery thereof whereby the leading edge of the stopped sheet is attracted to the drums, means for rotating the drums, and forward stop means aligned with the stack for stripping the leading edge of the sheet from the rotating drums, thereby to align the sheet with the stack.

18. A stacker for veneer sheets comprising in combination a support structure, an upwardly directed infeed conveyor, means for driving the conveyor at a predetermined speed, means for supplying a sheet of veneer to the infeed conveyor whereby the conveyor causes the sheet to travel at a predetermined velocity, a plurality of laterally spaced guide shoes carried by the supporting structure, the upstream end of the guide shoes arranged substantially adjacent the output end of the conveyor to smoothly intercept the moving veneer sheet, each guide shoe including a pair of coplanar inverted guide tracks forming an internal chamber therebetween, said chamber having an inlet throat, the guide tracks being curved with a rate of curvature adapted to divert the veneer sheet to follow an arcuate path defined by the underside of the guide tracks, a vacuum plenum carried by the support structure, an exhaust fan coupled to the plenum for creating a vacuum within the plenum, apertures in the plenum coupled to the guide shoe throats, a valve within each aperture for applying vacuum to the guide shoes, a switch having an actuator in the path of sheet travel, means responsive to the actuation of the switch for opening the valves, the switch being positioned so that the vacuum applied to the guide shoes serves to draw the veneer sheet to the guide shoes stopping the sheet substantially in stacking position, means for closing the valves to release the veneer sheet for falling, an elevating table below the guide shoes in the stacking position, a plurality of laterally spaced shell-like drums substantially contained within the vacuum plenum, the vacuum plenum including drum apertures at the downstream end of the guide shoes for exposing a portion of the periphery of the drums to the leading edge of the stopped veneer sheet, the drums including a patterned array of peripheral ports for attracting the leading edge of the stopped sheet, an aligning forward stop, and means for rotating the drums to carry the leading edge of the veneer sheet to the aligning stop when said sheet is released from the guide shoes.

19. The veneer stacker as set forth in claim 18 including means for maintaining the veneer sheet in contact with the infeed conveyor while the sheet is being carried by said conveyor.

20. The veneer stacker as set forth in claim 18 wherein the guide shoe throat is of enlarged configuration for rapid application of vacuum to the guide shoes in response to actuation of the switch, the valve including a slidable member adapted to close said aperture in a first position and to open said aperture in a second position, and means for rapidly moving said slidable member between said first and second positions.

21. A method of stacking veneer sheets including the steps of imparting a predetermined velocity to the veneer sheet, acting on the upper surface of the moving veneer sheet to divert the sheet and guide it to a stacking position in a curved path adapted to support the sheet, stopping the sheet when said sheet is guided substantially to a stacking position thereby allowing the sheet to fall, attracting the leading edge of the stopped sheet, and carrying said leading edge to an aligned stacking position as said sheet falls to the stack.

22. A method of stacking veneer sheets comprising the steps of imparting a predetermined velocity having an upward component to the veneer sheet, diverting the sheet to guide it in a curved path into substantially a stacking position, the curvature of the path being sufficient to support the sheet by means of centrifugal force, stopping the sheet when said sheet is substantially in stacking position and in contact with the guide means thereby to remove its source of support, and carrying the leading edge of the falling sheet into an aligned position on the stack.

23. The method as set forth in claim 22 wherein the step of diverting includes decreasing the radius of the curved path to increase the centrifugal force on the leading edge of the sheet.

* * * * *